US010227169B1

(12) United States Patent
Mueller et al.

(10) Patent No.: US 10,227,169 B1
(45) Date of Patent: Mar. 12, 2019

(54) DISPLAY BAGS WITH LINERS

(71) Applicant: Amazon Technologies, Inc., Seattle, WA (US)

(72) Inventors: Gordon Mueller, Edmonds, WA (US); Herman Hou Meng Chan, Seattle, WA (US); Sigifredo Carriedo Nunez, Seattle, WA (US); Shannon Quek, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 16 days.

(21) Appl. No.: 15/195,761

(22) Filed: Jun. 28, 2016

(51) Int. Cl.

| | |
|---|---|
| ***B65D 5/10*** | (2006.01) |
| ***B65D 75/38*** | (2006.01) |
| ***B65D 85/36*** | (2006.01) |
| ***B65D 65/10*** | (2006.01) |

(52) U.S. Cl.
CPC ..... *B65D 75/38* (2013.01); *B65D 5/10* (2013.01); *B65D 65/10* (2013.01); *B65D 85/36* (2013.01); *B65D 2585/363* (2013.01)

(58) Field of Classification Search
CPC ..... B65D 75/38; B65D 5/10; B65D 65/10; B65D 85/36; B65D 5/4204; B65D 33/04; B65D 77/0406; B65D 81/3461; B65D 5/38; B65D 81/203
USPC ..... 229/164.1, 902, 906, 904, 162.1, 87.08, 229/103.2, 903, 87.01; 206/769, 778, 206/223, 466, 548, 776; 383/106, 120; 426/396; 220/556, 662
See application file for complete search history.

(56) References Cited

U.S. PATENT DOCUMENTS

| | | | | |
|---|---|---|---|---|
| 3,650,383 | A * | 3/1972 | Nigro | B65D 5/38 206/509 |
| 4,494,689 | A * | 1/1985 | Ilitch | B65D 5/2038 206/525 |
| 9,382,043 | B2 * | 7/2016 | Rummo | B65D 75/522 |
| 2005/0274780 | A1 * | 12/2005 | Charlton | B65D 33/04 229/164.1 |

* cited by examiner

*Primary Examiner* — Christopher Demeree
(74) *Attorney, Agent, or Firm* — Athorus, PLLC

(57) ABSTRACT

Containers for baked goods such as cookies may include liners and bags. A liner may be formed from paperboard and include an enclosure that is defined by a plurality of panels. A lower portion of a baked good or another food product may be received within the enclosure, and an upper portion of the baked good may extend above the enclosure and be visibly supported by one or the panels. The liner may have dimensions that are selected to standardize the size of a baked good, and may be inserted into an appropriately sized bag that may be folded over the liner or otherwise sealed. The enclosure of the liner enables the baked good to be presented vertically on a shelf, rather than horizontally, and in series with other baked goods.

20 Claims, 9 Drawing Sheets

DISPLAY BAGS WITH LINERS

BACKGROUND

Baked goods such as cookies are typically formed from batter or dough, e.g., mixtures of flour, milk, eggs, yeast or one or more other flavored ingredients that are blended and kneaded into pliable, putty-like consistencies and cooked in ovens at increased temperatures. For example, prior to baking, cookie dough may be formed into balls, lumps, wedges or other flexible shapes or masses, deposited onto a sheet or tray, and placed in an oven. Once the dough begins to heat, butter within the dough melts, causing the dough to slowly collapse under its own weight, and to occupy a larger area on the sheet or tray. After the temperature of the dough reaches water's boiling point, water within the mixture turns to steam, thereby causing the dough to rise as vapors emanate therefrom. When the baking process nears its conclusion, sugars within the dough caramelize and mix with proteins from eggs and flours within the mixture. Subsequently, the sheet or tray is removed from the oven, and the baked dough is allowed to cool into a delicious treat that is enjoyable as a snack, or as one part of a course of a meal (e.g., a dessert), and at any time. Many other baked goods, such as pastries or pizzas, may be prepared in a similar manner, and baked or otherwise cooked according to similar processes.

Geometric properties of cookies and other baked goods tend to complicate the manner by which such goods may be presented or marketed to customers. After baking, a cookie takes a shape of a circular disc and typically having one crisp side, e.g., a side of the disc that contacted the sheet or tray during baking, and one soft side, e.g., an opposite side of the disc that was not in contact with the sheet or tray. The structural integrity of the soft side of a cookie may depend on the amounts or concentrations of flour, sugar or fats (e.g., butter) within the dough. Additionally, many cookies are often coated with ornate layers of frosting, icing or other toppings. Therefore, in many situations, stacking cookies atop one another may risk flattening one or more of the cookies, obscuring their surface textures and features, or marring the frosting, icing or toppings thereon, thereby adversely impacting both the appearance and the marketability of the cookies to customers. As a result, freshly baked cookies are often displayed to customers on a plate, which may be an inefficient use of space. Cookies without toppings, or those that are firm enough to endure contact with one another and remain intact or unmarred, also sometimes packaged loosely in boxes, and sold to customers. The surface textures and features of a cookie that is packaged in a box, like those of a cookie that is placed in a stack, are likewise hidden from view.

DETAILED DESCRIPTION

As is set forth in greater detail below, the present disclosure is directed to containers or other apparatuses having boxes and bags for displaying baked goods, including not only cookies but also bagels, biscuits, pastries, pies, quiches or other like food products having repeatable or consistent dimensions. More specifically, the systems and methods of the present disclosure are directed to containers having display bags and liners that permit substantially round and flat food products, such as cookies, to be displayed in a vertical manner that maintains the respective structural integrity of the food products while rendering at least a portion of their surfaces visible to customers. The display bags are sized to accommodate the liners therein, such that external dimensions of liners may correspond with internal dimensions of the display bags. In some implementations, one or more dimensions of the display bags or the liners may be selected based on attributes of a particular type or category of food product to be packaged and stored therein.

Figure 1A:
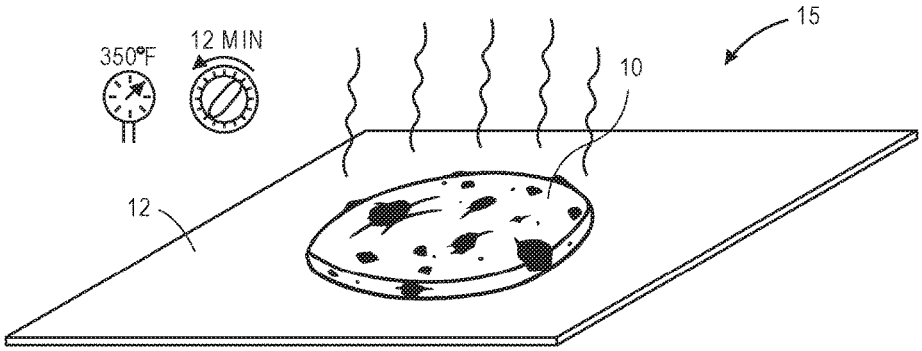
FIGS. 1A through 1F are views of one implementation of a container having a display bag and liner in accordance with the present disclosure.

Referring to FIGS. 1A through 1F, views of one implementation of a container 100 including a display bag and liner are shown. As is shown in FIG. 1A, a food product 10 such as a cookie may be placed into a controlled temperature environment 15 (e.g., an oven) on a cooking sheet or tray 12. The food product 10 may be permitted to cook therein in accordance with a predetermined cooking procedure, e.g., a recipe. In some embodiments, the food product 10 may include batter, dough or another liquid or pliable mixture, and may, as a result of a cooking process, be transformed into a disc-shaped morsel or sample.

Figure 1B:
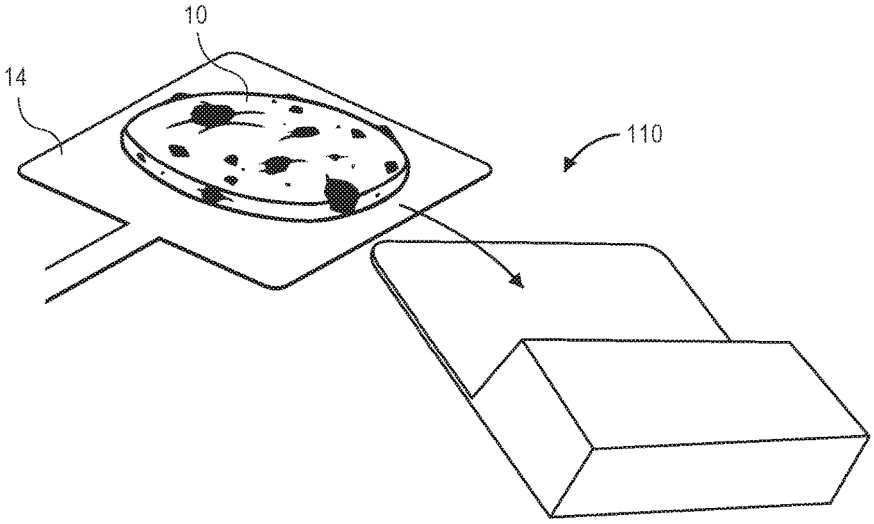
Figure 1C:
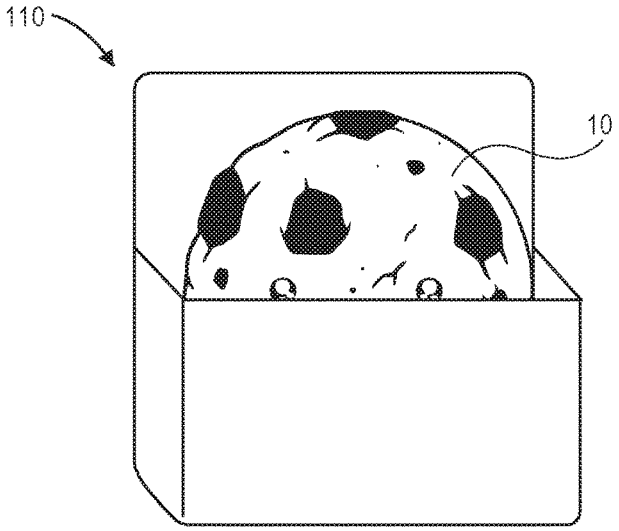

As is shown in FIGS. 1B and 1C, after the food product 10 has been cooked, the food product may be removed from the cooking sheet or tray 12 by a spatula 14 or a like utensil (e.g., a flipper or a peel), and placed into a liner 110 formed from a plurality of panels (or plates or sections). The liner 110 may include a back panel and an enclosure for receiving portions of food products, such as the food product 10. In the implementation of the liner 110 shown in FIG. 1B and FIG. 1C, the liner 110 is rigid or semi-rigid and includes a back panel that extends substantially higher than the enclosure, thereby enabling the food product 10 to be slid into the enclosure more easily. Additionally, the food product 10 may be placed into the enclosure of the liner 110 in a manner that causes a lower portion of the food product 10 to remain within and be supported by the enclosure, and an upper portion of the food product 10 to extend above the enclosure and be supported by the back panel while remaining visible to customers.

Figure 1D:
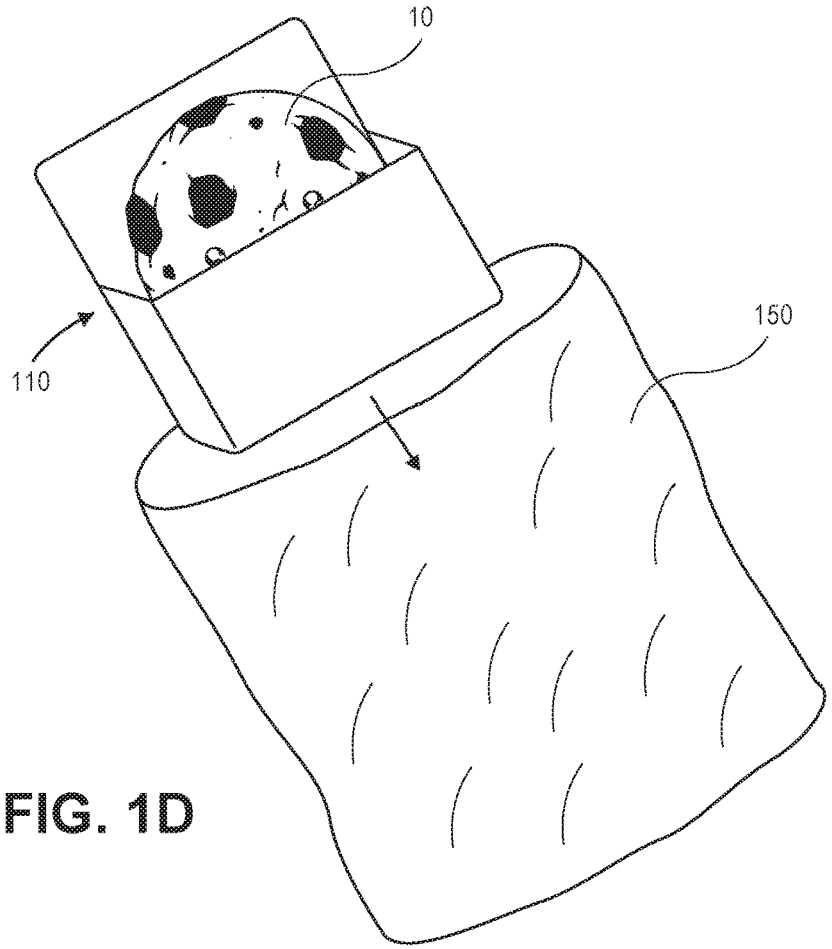
Figure 1E:
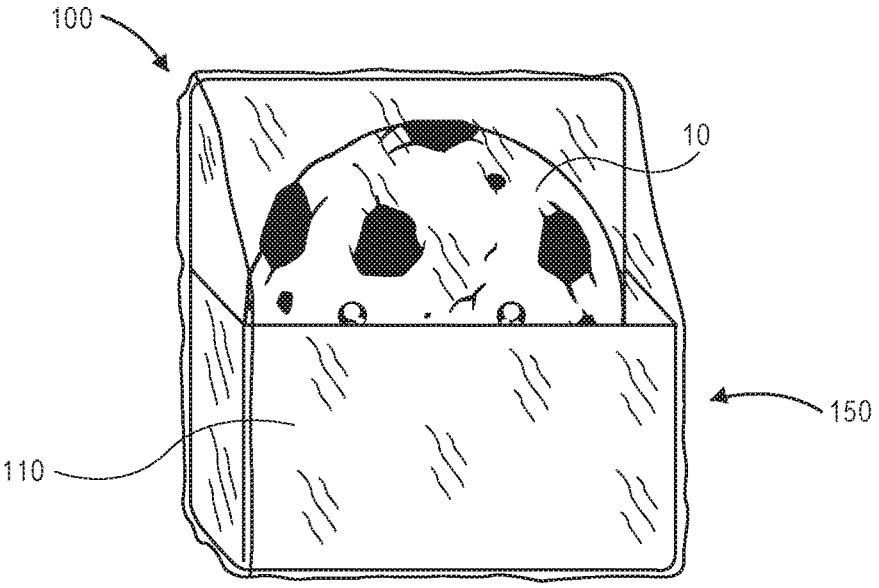

As is shown in FIG. 1D, after the food product 10 has been slid into the liner 110, the food product 10 and the liner 110 may be placed within a display bag 150. The display bag 150 may be formed from any type of transparent or translucent plastic including but not limited to cellophanes or like materials. The display bag 150 locks in moisture and protects the food product 10 against atmospheric contaminants or contact with humans or other objects, while enabling an upper portion of the food product 10 to remain visible therethrough. The display bag 150 of FIG. 1D includes an open end and a closed end. As is shown in FIG. 1E, after the liner 110 has been placed into the display bag 150 with the food product 10 therein, a portion of the open end may be folded behind the liner 110 and sealed, e.g., by an adhesive tape or other substance, or by crimping, heat-sealing or any other method.

Figure 1F:
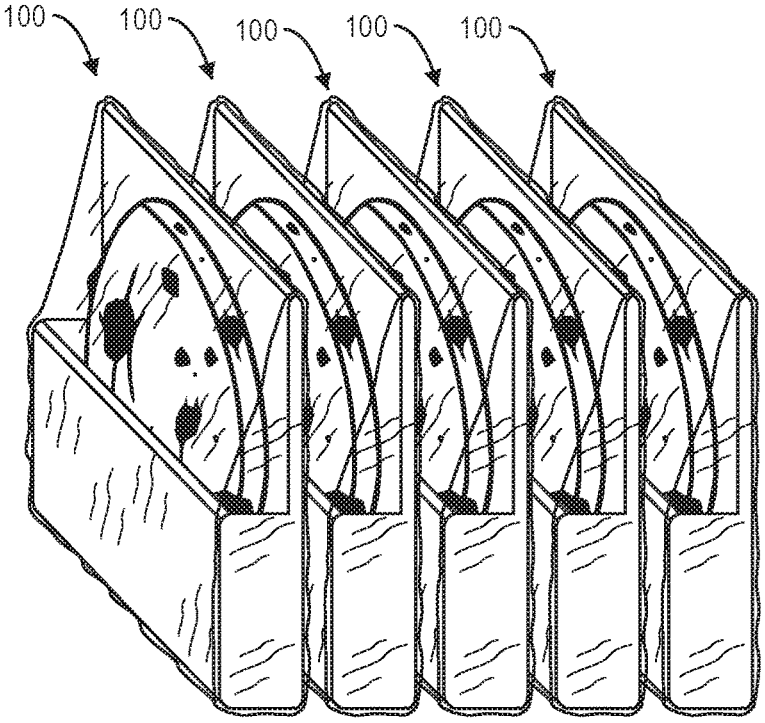

As is shown in FIG. 1F, a plurality of the containers 100 having food products within liners are aligned in series horizontally. Where the dimensions of the food product 10 (e.g., a width or diameter of the food product 10, or a thickness of the food product 10) are approximately the same as the dimensions of the enclosure, placing the food product 10 within the liner 110, and placing the liner 110 within the display bag 150, may thereby enhance the structural integrity of the food product 10 and enable the food product 10 to be uniformly stacked or aligned in series with one or more other food products without risking damage to its surface textures or features.

Accordingly, the systems and methods of the present disclosure may be used to preferentially display substantially thin food products having consistent or repeatable (e.g., nominal) dimensions. In some implementations, liners having enclosures and back panels that enable a food product that is normally aligned or presented in a horizontal manner to be aligned and presented vertically to customers. The liners may be placed into display bags that are sized and shaped to accommodate the liners and food products therein. In some implementations, liners and display bags may be sized and shaped to accommodate food products having substantially reliable and constant dimensions such as diameters or thicknesses, including but not limited to baked goods such as bagels, biscuits, cakes, cookies, cupcakes, knishes, muffins, pastries, pies, pizzas, quiches or others, as well as frozen foods such as ice cream sandwiches, cakes or bars, or freshly picked or cut foods such as pineapples. In some implementations, the food products need not have consistent or repeatable dimensions, yet by sliding or otherwise inserting such food products into the display bags or liners of the present disclosure, the presentation and marketing of such products may be normalized despite any differences in dimensions between such products.

The systems of the present disclosure may avoid the need to conceal food products in a box in order to ensure that they are adequately protected from external impacts. Instead, food products may be packaged and presented to customers in a more appetizing manner, and in a way that evokes the freshness of the product. Furthermore, where food products that are to be stored have consistent thicknesses, two or more of the food products may be stacked or aligned within containers or other apparatuses having liners and display bags, and presented to customers. The stiffness and durability of the liners enables such containers to be stocked on shelves or like surfaces by associates in a grocery store or like environment, removed from such shelves by customers, or returned to such shelves by customers or associates alike while minimizing the risk that the food product will be damaged during such transitions.

The liners of the present disclosure may be formed from any suitable cellulose-based or non-cellulose-based material, including but not limited to food-safe materials, that may enable a food product to be sufficiently supported, while protecting at least one portion of the food product from lateral impacts, and enabling at least another portion of the food product to remain visible therein. In some implementations, the liners may be formed from foldable materials such as cardboards (e.g., card stock, corrugated fiberboard or paperboards such as white board, solid board, chipboard or fiberboard) having thicknesses and weights that may be selected based on attributes of the food products to be retained therein (e.g., lengths, widths, thicknesses, masses of such food products). In some implementations, the materials from which the liners are formed may be rigid or semi-rigid in nature.

In some implementations, the liners may be formed from blanks cut from paperboard stock, including blanks of a single-piece construction having a number of panels that may be folded or shaped and sealed or adhered to one another. For example, the liners of the present disclosure, or the blanks from which such liners are formed, may be substantially rectangular in nature, with side edges and end edges defining corners that are pointed, beveled, tapered or rounded, or have any other configurations or shapes. In some implementations, the paperboard stock has an eighteen-point or a twenty-point thickness (0.018" or 0.020"), and one or more sides, surfaces or panels may be oil and grease resistant (or "OGR"). Such sides, surfaces or panels may be coated on one or more sides, e.g., with one or more grease resistant liquids or other substances that render the resistant to oils, greases or like substances (including but not limited to canola oil, corn oil, olive oil, palm oil, peanut oil, soybean oil, and other vegetable oils, or other oils or greases such as butter, lard, margarine, as well as condiments such as ketchup, mustard or salad dressing) that are commonly utilized in the preparation of foods or applied to the foods prior to their consumption.

In some embodiments, various panels of a blank may be pre-formed with scores and/or creases in specific locations on the blank where folding must occur in order to convert the blank (e.g., in a flat state) to a liner (e.g., in an assembled state). In some implementations, such locations may be pre-scored or pre-creased with a cut of approximately one-half of the thickness of the blank (e.g., a cut having approximately a nine-point depth into an eighteen-point thick piece of paperboard), thereby facilitating the folding of the blank in such locations. In some implementations, cuts of one-quarter or other fractions of the thickness of the blank may be made in various locations, as necessary. A blank may be independently scored or creased in different locations on either side of the blank, depending on a desired direction or magnitude of a fold that is required to place the blank in the flat state, or to fold the blank into a liner.

In some other implementations, the liners may be formed from a molded plastic material, e.g., in a single-piece construction, or in a layered construction, such as may be formed by an additive manufacturing system.

The display bags of the present disclosure may be formed from any suitable material that may encase, surround, envelop or shroud a liner having a food product therein. In some implementations, the display bags are formed from one or more layers of cellophane (e.g., regenerated cellulose), polyethylenes of any suitable density, or other transparent or translucent materials that are formed, fused, sealed or otherwise joined together. For example, the display bags may be formed from one or more layers of plastics such as co-extrusions, ethylene vinyl alcohols, laminates, polyamides, polycarbonates, polyesters, polyethylene napthalates, polyethylene terephthalates, polyolefins, polystyrenes, polyvinyl chlorides, polyvinylidene chlorides, or others. The display bags may feature open ends and may define cavities having closed ends that are sized to receive a liner having a food product therein, with sufficient surpluses or extensions of material that may be folded over the liner and taped, adhered or otherwise sealed to enclose the liner and the food product therein. The display bags may also be shrink-wrapped or heat-sealed around a liner having a food product therein. In some implementations, the display bags may be formed from cellophane or other transparent or substantially transparent materials having a thickness of two mils (0.0020"). In some other implementations, the display bags may be formed from cellophane or other transparent or substantially transparent materials having a thickness of one to one-and-one-half mils (0.0010" to 0.0015").

The display bags and the liners of the present disclosure may have any size or shape, as may be desired in order to receive, protect and store any generic or specific type of food product therein. For example, in some implementations, the display bags and the liners may be sized to accommodate pizzas or pies of any size or thickness, e.g., either frozen, thawed or cooked, including pizzas or other pies having diameters of eight inches, ten inches, twelve inches, fourteen inches, sixteen inches or eighteen inches, or larger diameters. In some other implementations, the display bags and the liners may be sized to accommodate cookies, muffins or other baked goods of any size or thickness, including baked goods having diameters of one inch or less.

Referring to FIGS. 2A through 2G, views of one implementation of a liner 210 in accordance with the present disclosure are shown. Except where otherwise noted, reference numerals preceded by the number "2" shown in FIGS. 2A through 2G indicate components or features that are similar to components or features having reference numerals preceded by the number "1" shown in FIGS. 1A through 1F.

Figure 2A:
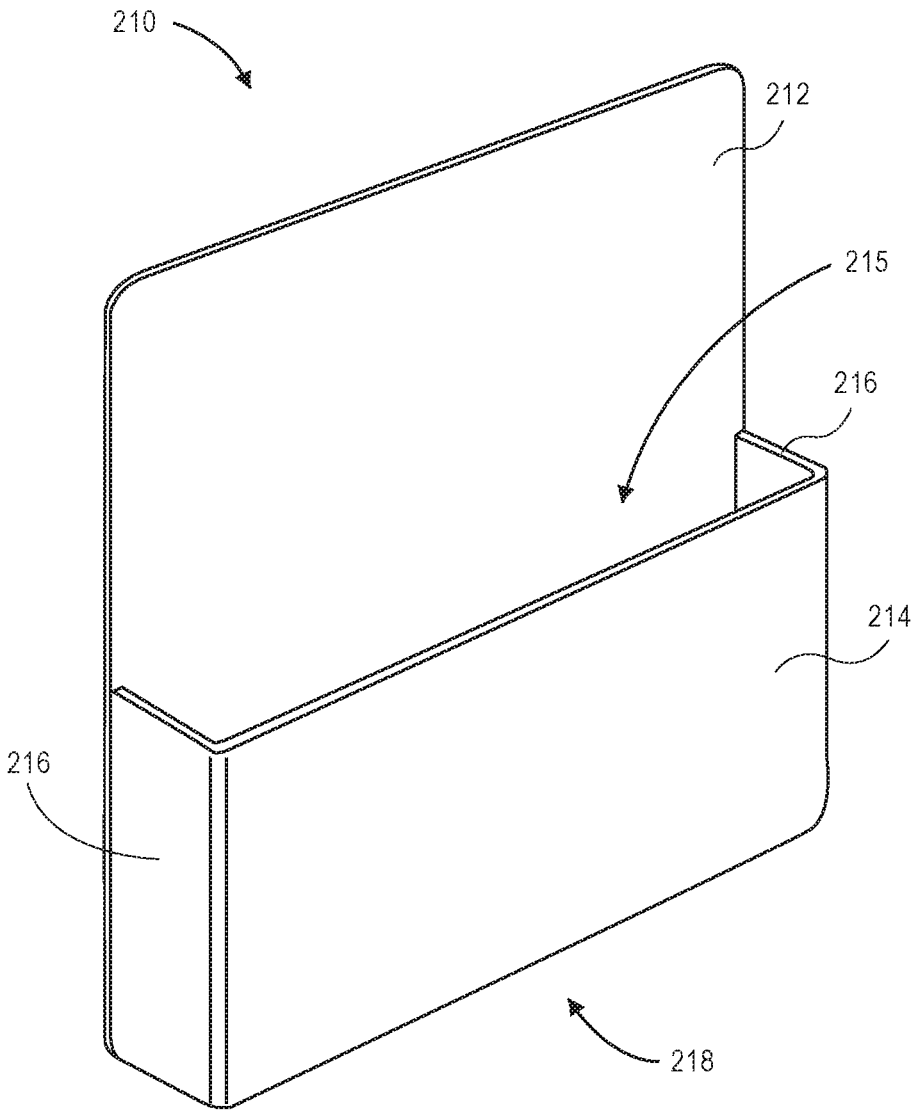
FIGS. 2A through 2G are views of one implementation of a liner in accordance with the present disclosure.
Figure 2B:
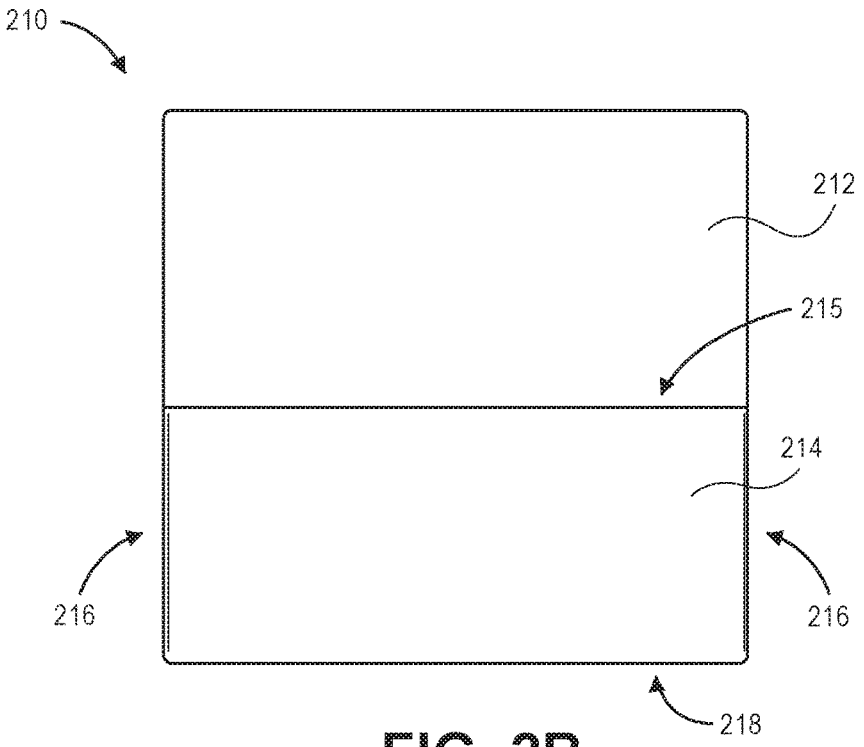
Figure 2C:
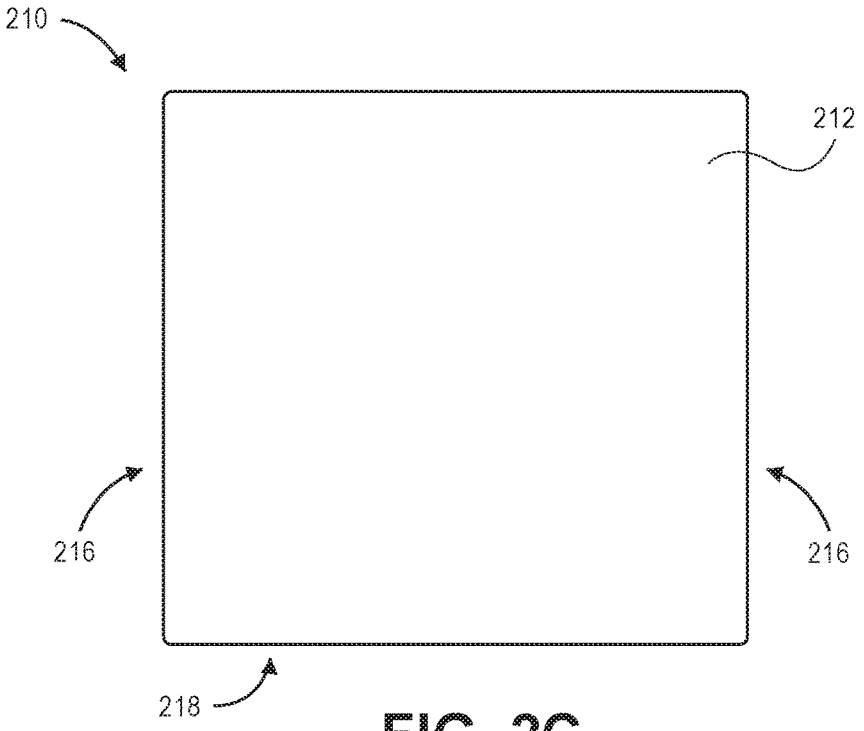
Figure 2D:
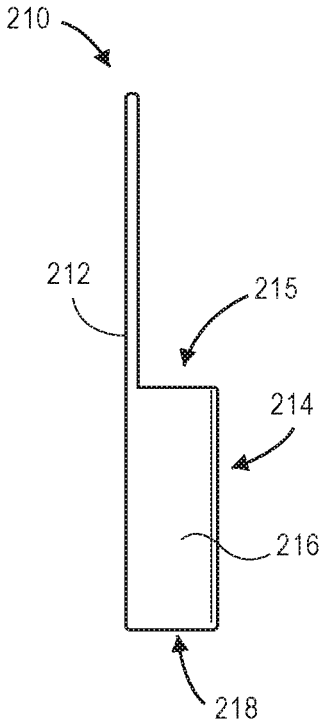
Figure 2E:
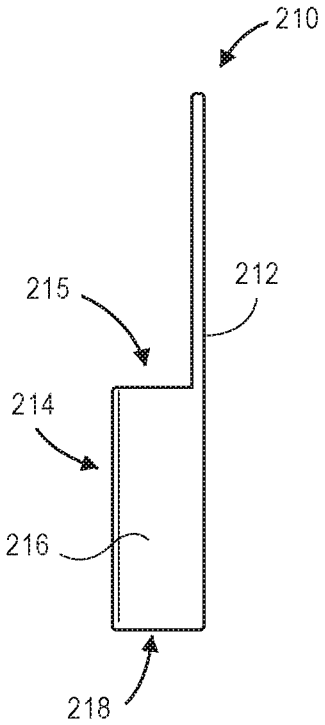
Figure 2F:
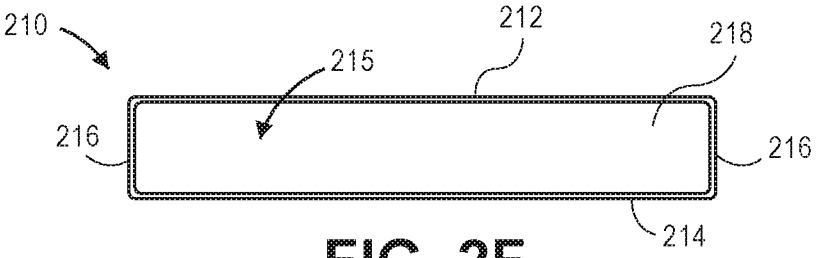
Figure 2G:
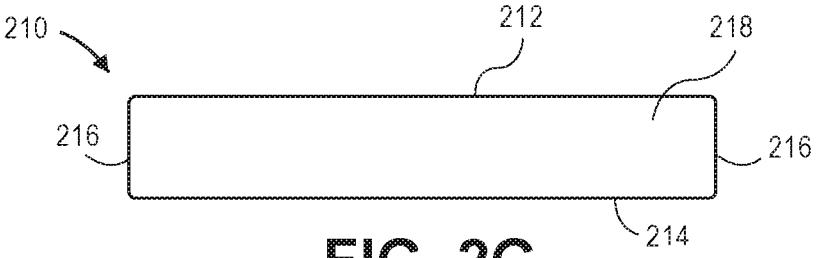

A perspective view of the liner 210 is shown in FIG. 2A. The liner 210 includes a back panel 212, a front panel 214, a pair of side panels 216 and a bottom panel 218. The front panel 214, the side panels 216, the bottom panel 218 and a lower portion of the back panel 212 define an enclosure 215 for accommodating a portion of a food product (not shown). A front view and a rear view of the liner 210 are shown in FIG. 2B and FIG. 2C, respectively. A left side view and a right side view of the liner 210 are shown in FIG. 2D and FIG. 2E, respectively. A top view and a bottom view of the liner 210 are shown in FIG. 2F and FIG. 2G, respectively.

As is shown in FIGS. 2A through 2G, the back panel 212 is parallel to the front panel 214. The back panel 212 and the front panel 214 are perpendicular to each of the side panels 216. The enclosure 215 includes an open end defined by upper edges of the side panels 216 and the front panel 214, and a closed end defined by lower edges of the side panels 216, the front panel 214, the back panel 212 and the bottom panel 216. In some implementations, widths and/or heights of the back panel 212 may be selected based on a maximum or nominal width or height of a food product to be received within the liner 210. In some other implementations, the widths and/or heights of the side panels 216 (e.g., depths of the enclosure 215) may be selected based on maximum or nominal thicknesses of a food product to be received within the liner 210.

As is discussed above, the dimensions of the liners of the present disclosure may be selected based on attributes of a particular type or category of food product to be stored therein. For example, referring again to the liner 210 of FIGS. 2A through 2G, dimensions of the enclosure 215 (e.g., a width of either of the side panels 216, or a width of the back panel 212) may be selected based on maximum or nominal dimensions of a food product (e.g., a width of a rectangular food product or a diameter of a round food product) to be accommodated therein. In some commercial settings, large numbers of food products such as cookies, bagels, ice cream sandwiches, personal-sized pizzas or the like may be prepared with consistent or repeatable dimensions wherein differences in such dimensions have minimal tolerances. Thus, liners of the present disclosure, such as the liner 210 of FIGS. 2A through 2G, may be designed and manufactured in large numbers for accommodating such food products therein. In some other commercial settings, the liners of the present disclosure may be sized to ensure that food products having dimensions that are not consistent or repeatable, or that regularly have differences in excess of predetermined tolerances, may be normalized when presented to customers by packaging such food products into such liners and in display bags accordingly.

Additionally, the liners of the present disclosure may take any shape or form. For example, although the back panel 212 of the liner 210 of FIGS. 2A through 2G is substantially in the shape of a square, those of ordinary skill in the pertinent arts will recognize that the back panels of liners of the present disclosure may also take a shape of a circle, an oval, an ellipse, or any polygon other than a square or other rectangle, in whole or in part, including but not limited to triangles, pentagons, hexagons, heptagons or octagons. Similarly, although the enclosure 215 of the liner 210 of FIGS. 2A through 2G is substantially in the shape of a rectangular hollow, the enclosures of liners of the present disclosure may likewise take any other shape. Similarly, those of ordinary skill in the pertinent arts will recognize that display bags of the present disclosure may take any shape that may accommodate liners and food products therein.

In some implementations, a back panel may have a square shape having sides five-and-one-quarter inches (5.25") in length, and a front panel may have a height of two inches (2") and a width of five-and-one-quarter inches (5.25"). In some implementations, side panels may have heights of two inches (2") and widths of five-eighths of one inch (0.625"), and bottom panels may have heights of five-eighths of one inch (0.625") and widths of five-and-one-quarter inches (5.25").

Furthermore, the back panels or the front panels of the present disclosure may further include any number of cutouts, voids or other openings that further enhance the visibility of a food product maintained therein. For example, although the front panel 214 of the liner 210 of FIGS. 2A through 2G is a substantially solid rectangle, the front panel 214 may take the shape of a letter U, such that more of the food product within the enclosure 215 is visible from a front surface while still providing protection to the food product against lateral impacts, e.g., to the front or the rear of the liner, or enabling food products to be stacked vertically or aligned horizontally without adversely affecting the surface textures or features of the food products.

Figure 3:
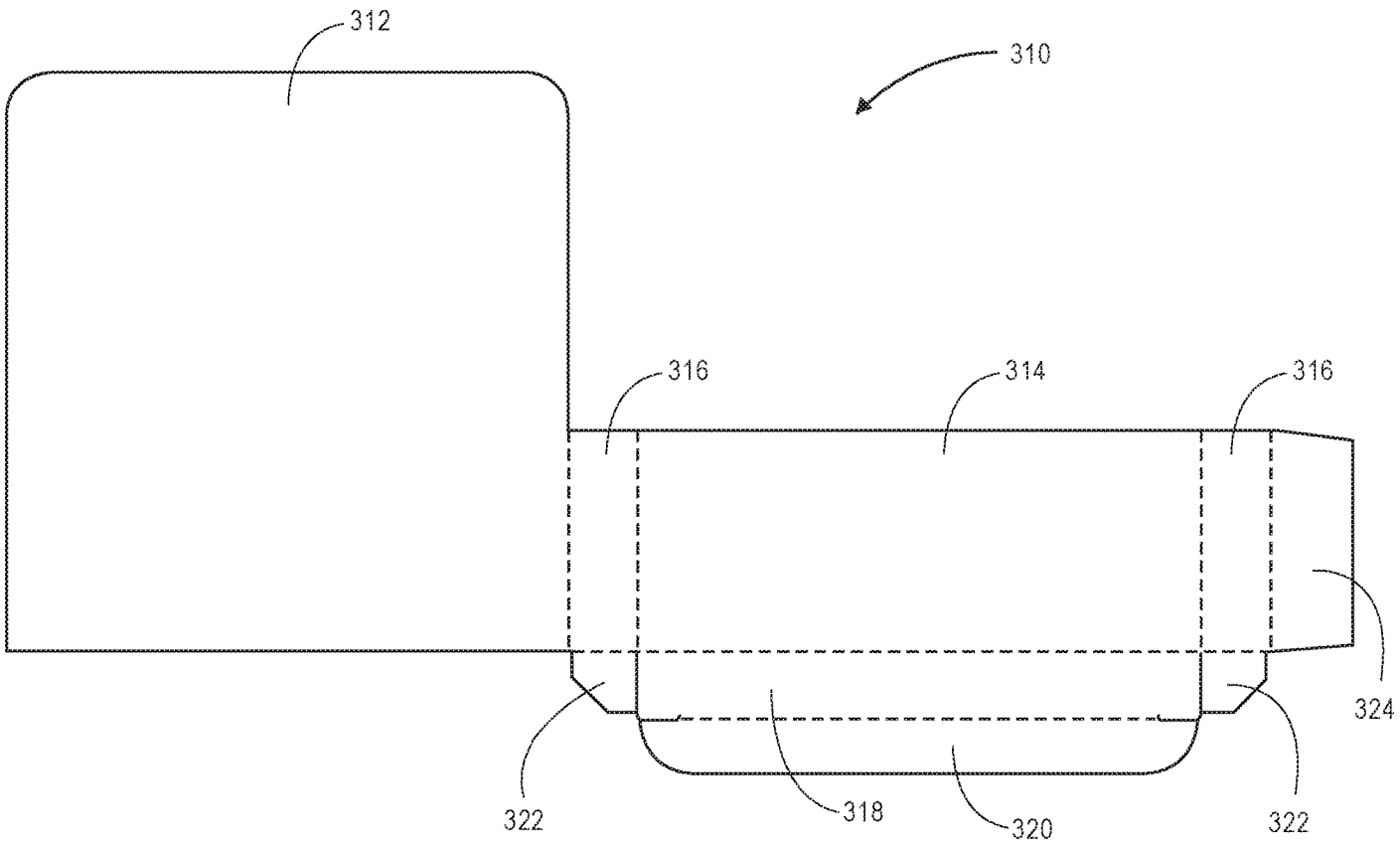
FIG. 3 is a view of one implementation of a blank from which a liner may be formed in accordance with the present disclosure.

Some of the liners of the present disclosure may be formed from a single paperboard blank. Referring to FIG. 3, a view of one implementation of a blank 310 from which a liner may be formed in accordance with the present disclosure is shown. Except where otherwise noted, reference numerals preceded by the number "3" shown in FIG. 3 indicate components or features that are similar to components or features having reference numerals preceded by the number "2" shown in FIGS. 2A through 2G or by the number "1" shown in FIGS. 1A through 1F.

As is shown in FIG. 3, the blank 310 is a substantially flat piece of paperboard, cardboard or like materials having a variety of sections or panels that may be folded, as necessary, in order to form a liner therefrom. The blank 310 includes a back panel 312, a front panel 314, a pair of side panels 316, a bottom panel 318, a bottom panel tab 320, a pair of side panel tabs 322 and an adhesive tab 324.

In accordance with the present disclosure, the blank 310 of FIG. 3 may be formed into a liner having an enclosure by folding the back panel 312 and the front panel 314 at right angles with respect to the side panel 316 to which each is joined, such that the back panel 312 and the front panel 314 are aligned in parallel with one another. Similarly, the front panel 314 and the adhesive tab 324 may also be folded at right angles with respect to the side panel to which each is joined, such that the front panel 314 and the adhesive tab 324 are aligned in parallel with one another. The adhesive tab 324 may be secured to a rear face of the back panel 312. Next, with the adhesive tab 324 secured to the rear face of the back panel 312, each of the side panel tabs 322 may be folded at right angles with respect to the side panels 316 to which each is joined. Finally, the bottom panel 318 may be folded at a right angle with respect to the front panel 314, and the bottom panel tab 320 may be folded at a right angle with respect to the bottom panel 318, such that the bottom panel tab 320 is tucked between the front panel 314 and the back panel 312.

Optionally, one or more adhesive tapes, layers, seals, stamps or other joining devices may be applied at or across two or more edges when the blank 310 is folded into a liner. For example, one or more adhesives may be applied to a rear face of the back panel 312 in order to join the adhesive tab 324 thereto. Likewise, one or more adhesives may be applied to the either of the side panel tabs 322, or to the bottom panel tab 320, in order to join the side panel tabs 322 to the bottom panel 318 or the bottom panel tab 320 to the back panel 312.

Figure 4A:
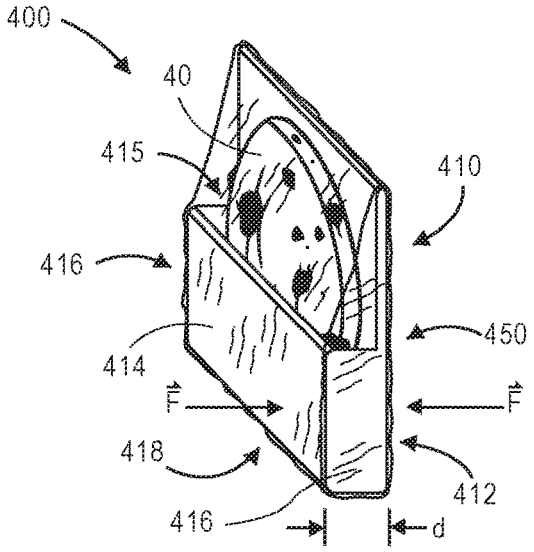
FIGS. 4A and 4B are views of one implementation of systems including a plurality of display bags and liners in accordance with the present disclosure.
Figure 4B:
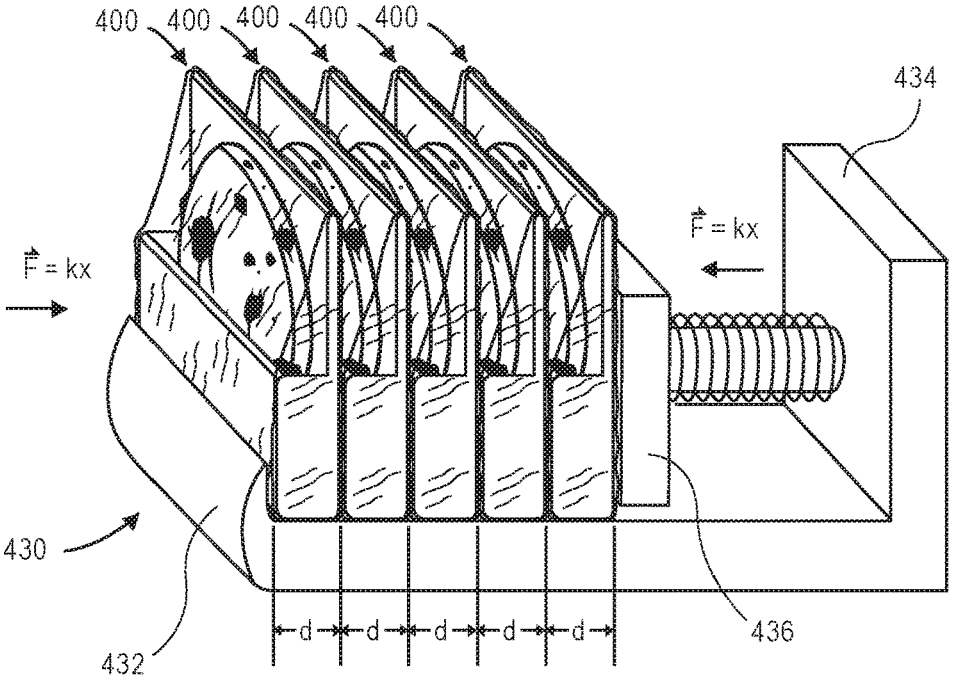

As is discussed above, the liners of the present disclosure may be shaped in a manner that permits food products stored therein to be displayed in a vertical, rather than horizontal, manner, and aligned in series with a number of other food products of similar or different types. Referring to FIGS. 4A and 4B, views of one implementation of a system including a plurality of display bags and liners in accordance with the present disclosure are shown. Except where otherwise noted, reference numerals preceded by the number "4" shown in FIG. 4A and FIG. 4B indicate components or features that are similar to components or features having reference numerals preceded by the number "3" shown in FIG. 3, by the number "2" shown in FIGS. 2A through 2G or by the number "1" shown in FIGS. 1A through 1F.

As is shown in FIG. 4A, a container 400 includes a food product 40, a liner 410 and a display bag 450. The liner 410 includes a back panel 412, a front panel 414, a pair of side panels 416 and a bottom panel 418. The food product 40 is shown within an enclosure 415 of the liner 410 defined by the back panel 412, the front panel 414, the side panels 416 and the bottom panel 418. The back panel 412 and the front panel 414 are separated by a distance d, which is slightly wider than a thickness t of the food product 40. The construction of the liner 410 enables the food product 40 to resist lateral forces of compression F that may be applied to either the back panel 412 or the front panel 414.

Accordingly, the construction of the liner 410 further enables a plurality of food products to be placed in such liners and aligned in series, in a manner that permits the liners to be subjected to a common spring-biased force while ensuring that portions of the food products remain visible to customers. As is shown in FIG. 4B, a plurality of the containers 400 of FIG. 4A are placed in series on a shelving unit 430 having a front ledge 432, a frame 434 and a spring-loaded plunger 436. Five of the containers 400 having food products therein are placed between the front ledge 432 and the plunger 436 and subjected to a forward spring-biased force by the plunger 436, and a rear force by the front ledge 432, in compression, on each of the liners 410 of the containers 400 in series, wherein the forward spring-biased force and the rear force are equal in magnitude and opposite in direction.

In accordance with the present disclosure, one or more of the containers 400 may be stocked in the shelving unit by associates in a grocery store or other materials handling facility, e.g., by pushing back upon the plunger 436, toward the frame 434, and inserting the containers 400 between the front ledge 432 and the plunger 436. Subsequently, a customer may remove one or more of the containers 400 from the shelving unit 430 by lifting the containers 400 upwardly above the front ledge 432 and removing such containers 400 therefrom. If the customer determines that he or she is no longer interested in one or more of the containers 400 that he or she removed from the shelving unit 430, the customer may return such containers 400 to the shelving unit 430 in a manner similar to that by which the containers 400 were stocked thereon, e.g., by pushing back upon the plunger 436, toward the frame 434, and inserting the containers 400 between the front ledge 432 and the plunger 436 or any other containers 400 thereon. The structural integrity of the liners 412 of such containers 400 permits the food products 40 to be stocked onto, removed from and returned to the shelving unit 430, or handled by customers, without adversely affecting any surface textures or features of the food products 40, while ensuring that portions of such food products 40 remain visible to customers.

Figure 5B:
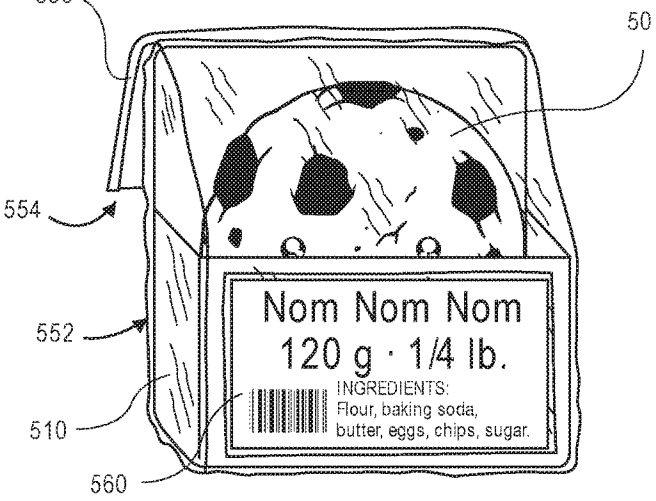
FIGS. 5A and 5B are views of one implementation of a system including a display bag and liner in accordance with the present disclosure.
Figure 5A:
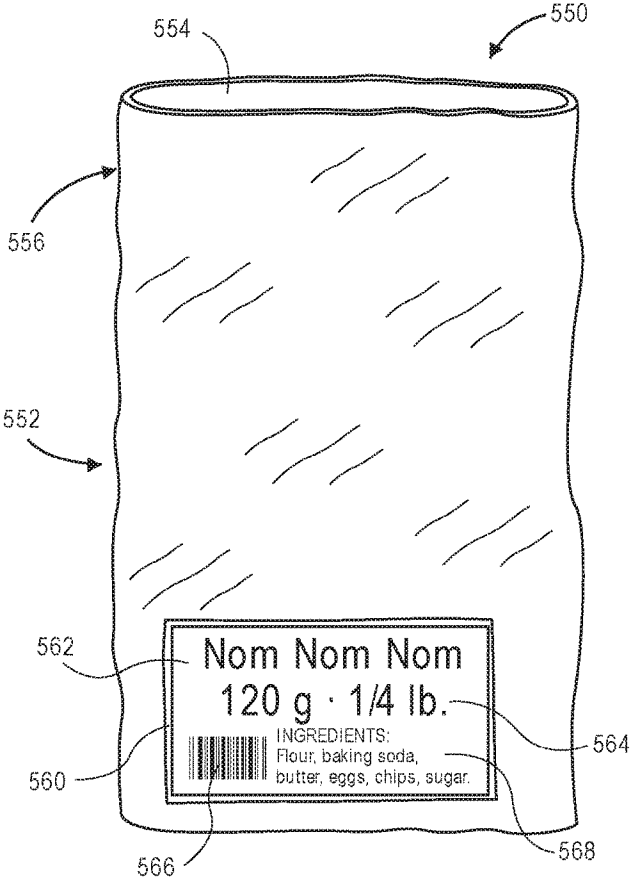

Referring to FIGS. 5A and 5B, views of one implementation of a system including a display bag and liner in accordance with the present disclosure are shown. Except where otherwise noted, reference numerals preceded by the number "5" shown in FIG. 5A and FIG. 5B indicate components or features that are similar to components or features having reference numerals preceded by the number "4" shown in FIG. 4A and FIG. 4B, by the number "3" shown in FIG. 3, by the number "2" shown in FIGS. 2A through 2G or by the number "1" shown in FIGS. 1A through 1F.

As is shown in FIG. 5A, the display bag 550 includes a lower body 552 having a closed end, an open end 554 and an upper extension 556. The display bag 550 further includes an adhesive label 560 on a front face. The adhesive label 560 includes a name 562 of a food product to be placed inside the display bag 550, e.g., within a liner, as well as a mass 564 of the food product, an optically readable bar code 566 or other marking, and details 568 (e.g., ingredients, prices, countries of origin, expiration dates, preparation or handling instructions) regarding the food product. The bar code 566 may be encoded with further information regarding the food product, or linked to further information regarding the food product.

As is discussed above, a liner having a food product therein may be inserted into the display bag 550 of FIG. 5A, which may then be sealed in any manner in order to enclose the liner and food product therein. As is shown in FIG. 5B, the display bag 550 includes a liner 510 having a food product 50 therein. The liner 510 and the food product 50 may be inserted into the lower body 552 of the display bag 550 by way of the open end 554 and through the upper extension 556. After the liner 510 has been fully inserted into the display bag 550, the upper extension 556 may be folded over the liner 510, e.g., from a front of the display bag 550 to a rear of the display bag 550, and adhered or otherwise sealed thereon. Alternatively, the display bag 550 may be sealed or enclosed in any other manner, such as by applying one or more tapes, layers, seals, stamps or other joining devices to one or more sides or faces of the display bag 550, by closing the display bag 550 in any other manner (e.g., one or more plastic zippers or other closing or reclosing agents), or by heat-sealing the open end 554 of the display bag 550, after which any surplus or excess material may be trimmed away. In some implementations, the display bag 550 need not be a bag at all, and may instead include one or more layers of plastic that are shrink-wrapped around the liner 510 with the food product 50 therein.

Although the disclosure has been described herein using exemplary techniques, components, and/or processes for implementing the systems and methods of the present disclosure, it should be understood by those skilled in the art that other techniques, components, and/or processes or other combinations and sequences of the techniques, components, and/or processes described herein may be used or performed that achieve the same function(s) and/or result(s) described herein and which are included within the scope of the present disclosure. For example, although some of the implementations of display bags and liners of the present disclosure are described herein in connection with the enclosure of prepared foods therein, those of ordinary skill in the pertinent arts will recognize that the present disclosure is not so limited, and that the display bags and liners may be provided in connection with the transportation and use of inedible products of any kind.

The systems and methods of the present disclosure may be utilized in connection with any type of food products, and are not limited for use in connection with cookies or other baked goods. Moreover, the blanks and containers of the present disclosure may be used in any type or form of facility, and are not limited in their application or implementation to facilities where foods are prepared and packaged.

Although some of the implementations of liners disclosed herein are referenced as being made from paperboard or cardboard, those of ordinary skill in the pertinent arts will recognize that the present disclosure is not so limited. The liners may be made from any suitable material, e.g., materials having one or more natural or synthetic fibers such as paper, plastic or fabric fibers, and may be provided with or without oil and grease resistant coatings. Additionally, although some of the embodiments are shown as having back panels that are substantially square, the liners formed therefrom may have any length or shape in accordance with the present disclosure.

It should be understood that, unless otherwise explicitly or implicitly indicated herein, any of the features, characteristics, alternatives or modifications described regarding a particular implementation herein may also be applied, used, or incorporated with any other implementation described herein, and that the drawings and detailed description of the present disclosure are intended to cover all modifications, equivalents and alternatives to the various implementations as defined by the appended claims. Moreover, with respect to the one or more methods or processes of the present disclosure described herein, orders in which such methods or processes are presented are not intended to be construed as any limitation on the claimed inventions, and any number of the method or process steps or boxes described herein can be combined in any order and/or in parallel to implement the methods or processes described herein. Also, the drawings herein are not drawn to scale.

Conditional language, such as, among others, "can," "could," "might," or "may," unless specifically stated otherwise, or otherwise understood within the context as used, is generally intended to convey in a permissive manner that certain implementations could include, or have the potential to include, but do not mandate or require, certain features, elements and/or steps. In a similar manner, terms such as "include," "including" and "includes are generally intended to mean "including, but not limited to." Thus, such conditional language is not generally intended to imply that features, elements and/or steps are in any way required for one or more implementations or that one or more implementations necessarily include logic for deciding, with or without user input or prompting, whether these features, elements and/or steps are included or are to be performed in any particular implementation.

Disjunctive language such as the phrase "at least one of X, Y, or Z," or "at least one of X, Y and Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain implementations require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

Language of degree used herein, such as the terms "about," "approximately," "generally," "nearly" or "substantially" as used herein, represent a value, amount, or characteristic close to the stated value, amount, or characteristic that still performs a desired function or achieves a desired result. For example, the terms "about," "approximately," "generally," "nearly" or "substantially" may refer to an amount that is within less than 10% of, within less than 5% of, within less than 1% of, within less than 0.1% of, and within less than 0.01% of the stated amount.

Although the invention has been described and illustrated with respect to illustrative implementations thereof, the foregoing and various other additions and omissions may be made therein and thereto without departing from the spirit and scope of the present disclosure.

What is claimed is:

1. A food container comprising:

a bag comprising an open end and a closed end, wherein at least a portion of the bag is substantially transparent;

a rigid liner disposed within the bag, wherein the rigid liner comprises:

a back panel having an upper portion and a lower portion;

a front panel parallel to the back panel;

a first side panel connected to the back panel and the front panel, wherein the first side panel is substantially perpendicular to the back panel and the front panel;

a second side panel connected to the back panel and the front panel, wherein the second side panel is substantially perpendicular to the back panel and the front panel, and wherein the second side panel is parallel to the first side panel; and a bottom panel having a first edge perpendicularly connected to a lower edge of the back panel, a second edge perpendicularly connected to a lower edge of the front panel, a third edge perpendicularly connected to a lower edge of the first side panel and a fourth edge perpendicularly connected to a lower edge of the second side panel, wherein the first side panel, the second side panel, the front panel, the bottom panel, and the lower portion of the back panel form an enclosure having an open end opposite the bottom panel that is defined by an upper edge of the front panel, an upper edge of the first side panel and an upper edge of the second side panel, and a closed end defined by the bottom panel, wherein each of the front panel, the back panel, the first side panel, the second side panel and the bottom panel is formed from a single piece of a paperboard, wherein the bottom panel is connected to the front panel at a first score, wherein a folding tab is connected to the bottom panel at a second score, wherein the bottom panel is folded substantially perpendicular to the front panel about the first score, and wherein the folding tab is folded substantially perpendicular to the bottom panel about the second score and tucked between the front panel and the back panel to define the closed end of the enclosure; and a food product accommodated within the rigid liner, wherein a lower portion of the food product is received within the enclosure between the front panel and the lower portion of the back panel, wherein an upper portion of the food product is visible above the open end of the enclosure and through the bag, and wherein the food container is configured to rest on at least one storage surface with at least one of a first portion of the bag corresponding to the bottom panel in contact with the food product accommodated within the rigid liner.

2. The food container of claim 1, wherein the food product has a height, a width and a maximum thickness, wherein a height of the back panel is substantially equal to the height of the food product, wherein a width of the enclosure is substantially equal to the width of the food product, and wherein a depth of the enclosure is substantially equal to the maximum thickness of the food product.

3. The food container of claim 1, wherein each of the back panel, the first side panel, the second side panel, the front panel and the bottom panel comprises a paperboard having a thickness of approximately eighteen points, wherein the bag comprises a cellophane material having a thickness of approximately two points, wherein the bag further comprises an adhesive label comprising information regarding the food product on a front surface of the lower body, and wherein an upper extension of the bag comprising the open end is folded over the back panel and sealed to a rear surface of the bag.

4. The food container of claim 1, wherein the food product has a shape of a disc, wherein the food product comprises one substantially soft side, one substantially crisp side and a perimeter, wherein the substantially crisp side of the food product is provided adjacent to a portion of an internal surface of the back panel within the enclosure, and wherein at least a portion of the perimeter of the food product is in contact with an internal surface of the bottom panel within the enclosure when the container rests on the at least one storage surface.

5. The food container of claim 1, wherein the food product is one of:

a bagel;
a biscuit;
a cake;
a cookie;
a cupcake;
at least a portion of a fruit;
an ice cream sandwich;
an ice cream cake;
a knish;
a muffin;
a pastry;
a pie;
a pizza; or
a quiche.

6. A container comprising:

a bag having an open end and a closed end; and a liner inside the bag, wherein the liner comprises an enclosure defined by a back panel, a front panel, a first side panel, a second side panel and a bottom panel for accommodating at least one food product within the liner, wherein the back panel is parallel to the front panel, wherein the first side panel is parallel to the second side panel, wherein each of the front panel, the first side panel and the second side panel has a first height, wherein the back panel has a second height, wherein the second height is greater than the first height, wherein each of the back panel and the front panel has a first width, wherein each of the first side panel and the second side panel has a second width, wherein each of the front panel, the back panel, the first side panel, the second side panel and the bottom panel is formed from a single piece of a paperboard, wherein the bottom panel is connected to the front panel at a first score, wherein a folding tab is connected to the bottom panel at a second score, and wherein the bottom panel is folded substantially perpendicular to the front panel about the first score, wherein the folding tab is folded substantially perpendicular to the bottom panel about the second score and tucked between the front panel and the back panel to define a closed end of the enclosure, and wherein the container is configured to rest on at least one surface with at least one portion of the bag corresponding to the bottom panel in contact with the at least one surface when the at least one food product is accommodated within the liner.

7. The container of claim 6, wherein an internal width of the bag is substantially equal to the first width, wherein an internal depth of the bag is substantially equal to the second width, and wherein an internal height of the bag is not less than the second height.

8. The container of claim 6, wherein the open end of the bag is folded over the back panel and sealed to an outer surface of the bag.

9. The container of claim 6, wherein the bag comprises a substantially transparent plastic material having a thickness of approximately two mils.

10. The container of claim 9, wherein the substantially transparent plastic material is at least one of a co-extrusion, an ethylene vinyl alcohol, a laminate, a polyamide, a polycarbonate, a polyester, a polyethylene, a polyolefin, a polystyrene, a polyvinyl chloride, or a polyvinylidene chloride.

11. The container of claim 6, wherein the bag comprises an adhesive label on at least one external surface of the bag, and wherein the adhesive label comprises at least one of a name of a food product, a mass of the food product, a price of the food product or an optically readable bar code encoded with information corresponding to the food product.

12. The container of claim 6, wherein the each of the first width and the second height is substantially equal to a nominal width of a food product or a nominal diameter of the food product, and wherein the second width is substantially equal to a nominal thickness of a food product.

13. The container of claim 6, wherein the first height is approximately two inches, wherein the second height is approximately five and one-quarter inches, wherein the first width is approximately five and one-quarter inches, and wherein the second width is approximately five-eighths of one inch.

14. The container of claim 6, wherein each of the front panel, the back panel, the first side panel, the second side panel and the bottom panel is formed from a cellulose-based material having a thickness of approximately eighteen one-hundredths of one inch.

15. The container of claim 6, wherein each of the front panel, the back panel, the first side panel and the bottom panel is formed from a cellulose-based material comprising at least one of a card stock, a corrugated fiberboard, a white board, a solid board, a chipboard or a fiberboard.

16. The container of claim 6, wherein sides of the front panel, the back panel, the first side panel, the second side panel and the bottom panel corresponding to interior surfaces of the enclosure are lined with a grease-resistant coating.

17. The container of claim 6, wherein the front panel comprises an opening cut into an upper edge of the front panel.

18. A container comprising:

a display bag formed at least in part from at least one plastic, wherein at least a portion of the display bag is translucent; and a liner inside the display bag, wherein the liner comprises an enclosure defined by a back panel, a front panel, a first side panel, a second side panel and a bottom panel, wherein each of the front panel, the back panel, the first side panel, the second side panel and the bottom panel is formed from a single piece of a paperboard, wherein each of the front panel, the first side panel and the second side panel has a first height, wherein the back panel has a second height, wherein the second height is greater than the first height, wherein each of the back panel and the front panel has a first width, wherein each of the first side panel and the second side panel has a second width, wherein the bottom panel is connected to the front panel at a first score, wherein a folding tab is connected to the bottom panel at a second score, wherein the bottom panel is folded substantially perpendicular to the front panel about the first score, and wherein the folding tab is folded substantially perpendicular to the bottom panel about the second score and tucked between the front panel and the back panel to define a closed end of the enclosure.

19. The container of claim 18, further comprising a disc-shaped food product disposed within the enclosure, wherein the disc-shaped food product comprises one substantially soft side, one substantially crisp side and a perimeter, wherein the substantially crisp side of the disc-shaped food product is provided adjacent to a portion of an internal surface of the back panel within the enclosure, and wherein at least a portion of the perimeter of the disc-shaped food product is in contact with an internal surface of the bottom panel within the enclosure when the container rests on at least one storage surface with at least a portion of the bag corresponding to an external surface of the bottom panel in contact with the at least one storage surface.

20. The container of claim 19, wherein the disc-shaped food product is one of:

a bagel;
a biscuit;
a cake;
a cookie;
a cupcake;
at least a portion of a fruit;
an ice cream sandwich;
an ice cream cake;
a knish;
a muffin;
a pastry;
a pie;
a pizza; or
a quiche.

* * * * *